US009849950B2

(12) United States Patent
Stickler

(10) Patent No.: US 9,849,950 B2
(45) Date of Patent: Dec. 26, 2017

(54) FLOATATION DEVICE

(71) Applicant: Mark A. Stickler, Katy, TX (US)

(72) Inventor: Mark A. Stickler, Katy, TX (US)

( * ) Notice: Subject to any disclaimer, the term of this patent is extended or adjusted under 35 U.S.C. 154(b) by 0 days.

(21) Appl. No.: 15/284,458

(22) Filed: Oct. 3, 2016

(65) Prior Publication Data

US 2017/0096203 A1 Apr. 6, 2017

Related U.S. Application Data

(60) Provisional application No. 62/236,793, filed on Oct. 2, 2015.

(51) Int. Cl.
*B63C 9/135* (2006.01)

(52) U.S. Cl.
CPC ..... *B63C 9/135* (2013.01)

(58) Field of Classification Search
CPC ..... B63C 9/093; B63C 9/115
See application file for complete search history.

(56) References Cited

U.S. PATENT DOCUMENTS 3,023,433 A * 3/1962 Davyso ..... A41D 7/001 441/115

* cited by examiner

*Primary Examiner* — Edwin Swinehart
(74) *Attorney, Agent, or Firm* — Mark R. Wisner

(57) ABSTRACT

A floatation device is configured to provide floatation without interfering with a user's upper body movement. The floatation device has a first set of four straps adapted to encircle the user's hips. A right thigh floatation pad and a right back hip floatation pad are joined to the first four straps. A first elastic band is joined to the first four straps and a waist floatation pad. A second set of four straps are adapted to encircle the user's hips. A left thigh floatation pad and a left back hip floatation pad are joined to the first four straps. A second elastic band is joined to the second four straps and a second waist floatation pad. Three elastic bands are joined to four floatation pads and the second elastic band. Three straps with buckles are attached to the elastic bands.

4 Claims, 2 Drawing Sheets

FLOATATION DEVICE

This application claims the benefit of U.S. provisional application No. 62/236,793, filed Oct. 2, 2015. Application No. 62/236,793 is hereby incorporated into this application in its entirety by this specific reference thereto.

BACKGROUND OF THE INVENTION

The embodiments described herein relate generally to devices that enable a user to stay afloat in water.

Prior to embodiments of the disclosed invention, when using a "life jacket" or some similar variety of personal floatation device for swimming or exercising in a body of water it would rise up around one's neck or armpits after continuous movement along with limiting upper body mobility. It is an object of the embodiments of the disclosed invention to solve this problem.

Another object of the present invention is to provide a floatation device that tends to keep a person upright in the water so that the person's head stays above water. Other floatation devices and/or so-called life vests are available that are intended to solve this same problem but so far as is known, the currently available floatation devices intended to solve this problem are bulky, difficult to put onto the person, and/or restrict the movements of the person wearing the device.

Another object of the present invention is to provide a personal floatation device that is easy to put onto a person. Specifically, it is an object to provide a personal floatation device that is put onto the person by, in effect, having the person sit down into the device and then simply snugging three straps around the person.

This listing of some of the objects of the present invention is intended to be illustrative. Other objects, and the many advantages of the present invention, will be made clear to those skilled in the art in the following detailed description of the preferred embodiment(s) of the invention and in any drawing(s) appended hereto. Those skilled in the art will recognize, however, that the embodiment(s) of the present invention described herein are only examples of specific embodiment(s) of the invention, set out for the purpose of describing the making and using of the invention, and that the embodiment(s) shown and/or described herein are not the exclusive way(s) to implement the teachings of the present invention.

BRIEF SUMMARY OF THE INVENTION

These several objects, and the advantages of the present invention, are met by providing a floatation device that is configured to provide floatation without interfering with a user's upper body movement. The floatation device has a first set of four straps adapted to encircle the user's hips. A right thigh floatation pad and a right back hip floatation pad are joined to the first four straps. A first elastic band is joined to the first four straps and a waist floatation pad. A second set of four traps are adapted to encircle the user's hips. A left thigh floatation pad and a left back hip floatation pad are joined to the first four straps. A second elastic band is joined to the second four traps and a second waist floatation pad. Three elastic bands are joined to four floatation pads and the second elastic band. A first strap with buckle is attached to the first elastic band. A second strap with buckle is attached to the second elastic band. A third strap with buckle is attached to the three elastic bands. Tightening the three elastic bands enables a user to wear the floatation device providing floatation without interfering with upper body movement.

In a second aspect, the present invention provides a floatation device comprised of pieces of buoyant material, a first piece of buoyant material being shaped in a "U" that is inverted for wearing by a person, the "U" shape of the first piece of buoyant material being defined by two stems and a counter, the person wearing the floatation device by sitting down into the end of the "U" of the "U"-shaped first piece of buoyant material opposite the counter of the "U" with the stems of the "U" being arrayed on either side of the person's buttocks. Second and third pieces of buoyant material are attached to the stems of the "U" forming the first, "U"-shaped piece of buoyant material at approximately the waist of the person wearing the floatation device, and an elongate belt is affixed to each of the first, "U"-shaped and the second and third pieces of buoyant material for wrapping all of said first, second, and third pieces around the person's waist. Fourth and fifth "T"-shaped pieces of buoyant material are attached to both the first, "U"-shaped and respective second and third pieces of buoyant material, the "T" shape of the fourth and fifth pieces of buoyant material being defined by a stem and a bar with the "T" being inverted for wearing by the person. Respective elongate straps are affixed to the fourth and fifth, "T"-shaped pieces of buoyant material and oriented in a direction substantially parallel to the bar of the "T" of the respective fourth and fifth, "T"-shaped pieces of buoyant material for wrapping around respective thighs of the person.

In another aspect, the present invention provides a floatation device for providing buoyancy when worn by a person comprising a "U"-shaped piece of buoyant material and first and second flaps comprised of buoyant material attached to the "U"-shaped piece of buoyant material. An elongate belt is affixed to each of the "U"-shaped pieces of buoyant material and the first and second flaps and provided with connectors on the ends of the belt for encircling the waist of the person when the connectors of the belt are connected. First and second "T"-shaped pieces of buoyant material are attached to both the "U"-shaped piece of buoyant material and the respective first and second flaps and first and second respective elongate straps are affixed to each respective "T"-shaped pieced of buoyant material, each of the first and second straps being provided with connectors for wrapping the respective first and second straps, and the respective "T"-shaped pieces of buoyant material, around the respective thighs of the person when the connectors are connected.

BRIEF DESCRIPTION OF THE DRAWINGS

The detailed description of some embodiments of the invention is made below with reference to the accompanying figures, in which.

DETAILED DESCRIPTION OF THE INVENTION

Figure 1:
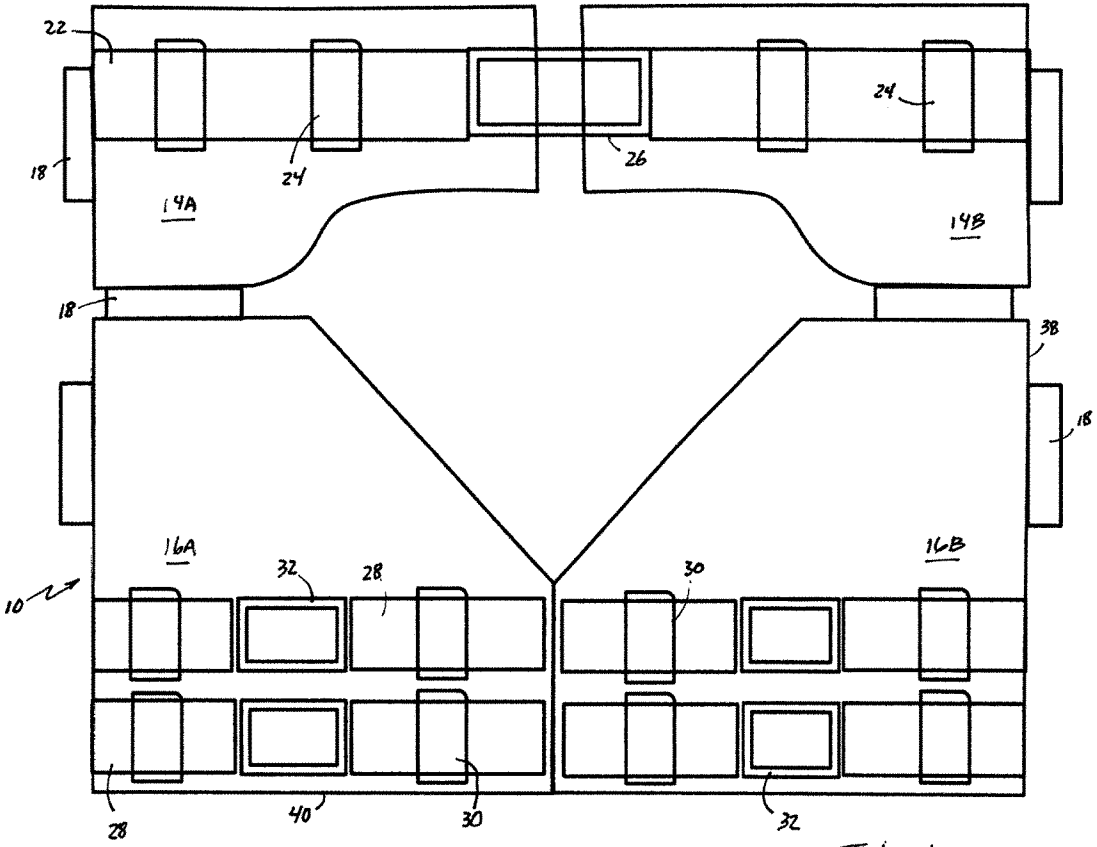
FIG. 1 is a top plan view of a first embodiment of a floatation device constructed in accordance with the teachings of the present invention.

Referring now to the figures, a first embodiment of the of the present invention is indicated generally at reference numeral 10 in FIG. 1. In the embodiment shown, the present invention comprises a first set of four straps adapted to encircle the user's hips. A right thigh floatation pad and a right back hip floatation pad are joined to the first four straps. A first elastic band is joined to the first four straps and a waist floatation pad. A second set of four straps are adapted to encircle the user's hips. A left thigh floatation pad and a left back hip floatation pad are joined to the first four straps. A second elastic band if joined to the second four straps and a second waist floatation pad. Three elastic bands are joined to four floatation pads and the second elastic band. A first strap with buckle is attached to the first elastic band. A second strap with buckle is attached to the second elastic band. A third strap with buckle is attached to the three elastic bands. Tightening the three elastic bands enables a user to wear the floatation device providing floatation without interfering with upper body movement. In some embodiments a molded design can be made of one or two piece units.

Turning to these components in more detail, the first set of four straps can be comprised of four bent polyvinyl chloride (PVC) straps adapted to encircle the user's hips. The right thigh pad can be comprised of one piece of molded 2# cross linked polyethylene for the right thigh area in a variety of sizes and shapes as to allow a person to stay buoyant. The right back hip pad can be comprised of one piece of molded 2# cross linked polyethylene for the right back hip area in a variety of sizes and shapes as to allow a person to stay buoyant.

The second set of four straps can be comprised of four bent PVC straps adapted to encircle a user's hips. The left thigh pad can be comprised of one piece of molded 2# cross linked polyethylene for the left thigh area in a variety of sizes and shapes as to allow a person to stay buoyant. The left back hip pad can be comprised of one piece of molded 2# cross linked polyethylene for the left back hip area in a variety of sizes and shapes as to allow a person to stay buoyant. In other embodiments, these straps can also be made from: Velcro®, neoprene, polypropylene, polyester, corded/woven and composite among other materials.

The three elastic bands can be comprised of three pieces of two inch wide elastic bands of sufficient lengths to allow for the various widths of children and adults waist. The four pads can be comprised of four pieces of molded 2# cross linked polyethylene foam in a variety of sizes and shapes as to allow a person to stay buoyant. Other kinds of fasteners besides buckles may also be utilized to advantage, including Velcro®, snaps, buttons and zippers.

In another embodiment (not shown), eight leg straps that include eight pieces of one inch wide elastic bands of sufficient lengths are provided to allow for the various lengths of children's and adults' leg sizes. The waist pad can be comprised of one piece of molded 2# cross linked polyethylene foam for the waist in a variety of sizes and shapes as to allow a person to stay buoyant. The elastic bands can be comprised of one piece of two inch wide elastic bands of sufficient lengths to allow for the various diameters of the thighs of children and adults.

The second waist pad can be comprised of one piece of molded 2# cross linked polyethylene foam for the waist in a variety of sizes and shapes as to allow a person to stay buoyant. The straps can be comprised of either a one inch or a two inch nylon strap with a plastic buckle. Embodiments can be produced with different buoyancy products. This can include any crossed linked polypropylene from #2-#6, Zotek, XLPE, EPDM, air chambers, Vinyl covered foam, neoprene, polyurethane, polymer/plastic, Thermoplastic, Microballons, Macro-spheres, AquaCell® Foam, Expanded Polystyrene, and Polystyrene, Styro Foam® among others. These materials can be covered with vinyl, rubber, EPDM, Neoprene, nylon, Lycra, Artica, Gore-Tex, Nikwax Analogy, microfiber, polyester, FurTech, and Cotton, among others, but those skilled in the art who have the benefit of this description will recognize that the covering is not required for the floatation device 10 to function for its intended purpose and therefore is not addressed herein in any further detail.

Persons of ordinary skill in the art may also appreciate that numerous design configurations may be possible that enjoy the functional benefits of the inventive systems. For example, the system may comprise of an elastic garment to which floatation foam may be affixed to or sewn into the garment on the outside. Alternatively, an embodiment is made with a molded design of any of the above listed buoyance products, or buoyant materials, thus allowing the embodiment to be made with any number of buoyant products.

Referring again to the drawings, FIG. 1 shows the embodiment 10 of the floatation device of the present invention being comprised of five pieces or sections of the buoyancy products described above, referred to generically herein as "buoyant material," a hip floatation pad 12, two waist floatation pads 14A, 14B, and two thigh floatation pads 16A, 16B. By reference to FIG. 2, it can be seen that the first piece of buoyant material, the hip floatation pad 12, is "U"-shaped when spread flat and viewed from either above or below, and that the first and second pieces of buoyant material, forming the waist floatation pads 14A, 14B, are attached to the first piece of buoyant material 12 by the above-described connector bands 18. Both the U-shaped first piece of buoyant material 12 and the first and second waist floatation pads 14A, 14B are attached to first and second thigh floatation pads 16A, 16B and the thigh pads, when flattened out and viewed from above, are shaped in the form of an inverted "T."

A belt 22, held to the first piece of buoyant material 12 and to the first and second flaps forming the waist floatation pads 14A and 14B by one or more belt loops 24, is provided with a buckle 26 and, as set out in more detail below, encircles the waist of the person wearing the floatation device 10 when buckle 26 is buckled. Similarly, one or more thigh straps 28 is held to the first and second "T"-shaped pieces of buoyant material that function as thigh pads 16 by a plurality of loops 30 and when the buckle(s) 32 of thigh straps 28 are buckled, the "T"-shaped pieces of buoyant material encircle the thighs of the person wearing the floatation device 10. Those skilled in the art who have the benefit of this disclosure will recognize that the function of buckle 26 can also be accomplished by hooks, hook and loop fasteners, buttons, zippers, and in many other ways, and all such structure is therefore referred to generically herein as a "connector."

Figure 2:
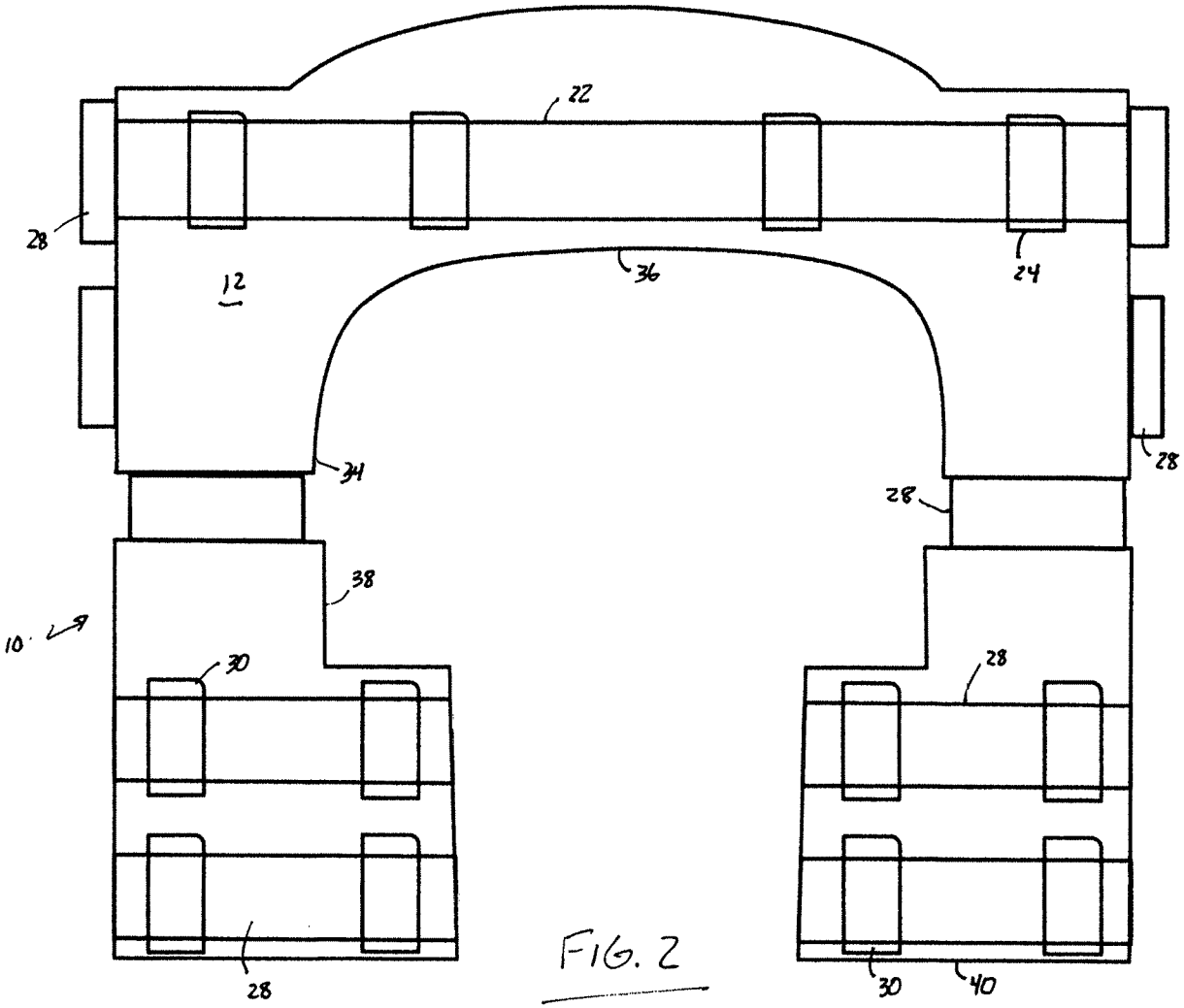
FIG. 2 is a plan view of the floatation device of FIG. 1, taken from the side opposite the view of FIG. 1, after the straps have been tightened around the portions of the floatation device that encircle the thighs of the person wearing the floatation device.

In order to describe the manner in which the floatation device 10 functions to achieve its intended purpose, the shape of at least the first piece of buoyant material (hip floatation pad) 12 and the first and second "T"-shaped pieces of buoyant material (the thigh floatation pads) 16A, 16B is described in more detail. Specifically, and as best shown in FIG. 2, the "U" of the "U"-shaped waist pad 12 is defined by two stems 34 and a counter 36 and is inverted relative to each of the thigh pads 16A, 16B. The waist pads 14A, 14B and thigh pads 16A, 16B are, as described above, attached to hip pad 12 along and/or at the ends of the two stems comprising the "U" of waist pad 12. The belt 22 crosses the "U" of the "U"-shaped waist pad 12 at the end of the "U" defined by the counter 36 and although the hip pads 14A, 14B are attached to waist pad 12 by the connector bands 18, it can be seen that the belt 22 and belt loops 24 also function to hold the three pieces of buoyant material 12, 14A, 14B to each other.

When a person puts the floatation device 10 of the present invention onto their body, they do so by wrapping the waist pad 12 and hip pads 14A, 14B around their waist and fastening the buckle 26 on the ends of belt 22, drawing the buckle tight by tugging on the loose end of the belt 22 to snug the waist and hip pads 12, 14A, 14B around the person's waist. When donned in this manner, the counter 36 of the "U"-shaped waist pad 12 is positioned across the small of the back slightly above the buttocks and with the stems 34 of the "U"-shaped waist pad draped around, or encircling the person's buttocks (stated another way, when the buckle 26 is fastened around the waist of the person and the person sits down, the person's buttocks will be positioned so that the person sits onto the stems 34 of the "U"-shaped waist pad 12 in much the same way that a person sits on a toilet seat in a public restroom).

The "T" of each of the first and second "T"-shaped pieces of buoyant material comprising thigh pads 16A, 16B is defined by a stem 38 and crossbar 40 and the straps 28 that are threaded through loops 30 are oriented in a direction substantially parallel to the crossbar 40 of the "T"-shaped thigh floatation pad. When the waist pad 12 and hip pads 14A, 14B are fastened around the person's waist in the manner described above, the "T" of thigh pads 16A, 16B is inverted so that the stem of the "T"-shape that defines the "T"-shaped thigh pads 16A, 16B is substantially parallel to the person's legs and the crossbar 40 of the "T" is substantially perpendicular to the person's legs. The person then fastens the buckles 32 on the ends of the thigh straps 28 affixed to each of the "T"-shaped thigh pads 16A, 16B and draws the straps 28 tight to snug the buoyant material comprising the crossbar 40 of each of thigh pads 16A, 16B around the person's respective thighs. In this manner, the floatation device 10 of the present invention is quickly and easily donned by the person and causes minimal restriction in the motion of the person while being worn.

Thus, given the wide variety of configurations and arrangements of embodiments of the present invention the scope of the invention is reflected by the breadth of the claims below rather than narrowed by the embodiments described above.

What is claimed is:

1. A floatation device for providing buoyancy when worn by a person comprising:

a "U"-shaped piece of buoyant material;

first and second flaps comprised of buoyant material attached to said "U"-shaped piece of buoyant material;

an elongate belt affixed to each said "U"-shaped piece of buoyant material and said first and second flaps with connectors on the ends of said belt for encircling the waist of the person when the connectors of said belt are connected;

first and second "T"-shaped pieces of buoyant material attached to both said "U"-shaped piece of buoyant material and said respective first and second flaps; and first and second respective elongate straps affixed to each respective "T"-shaped piece of buoyant material, each of said first and second straps being provided with connectors for wrapping said respective first and second straps, and the respective "T"-shaped pieces of buoyant material, around the respective thighs of the person when the connectors are connected.

2. The floatation device of claim 1 wherein said "U"-shaped piece of buoyant material is inverted relative to the person's buttocks when the connectors on the ends of the elongate belt affixed to said "U"-shaped piece of buoyant material are connected.

3. The floatation device of claim 2 wherein said "T"-shaped pieces of buoyant material are inverted relative to the person's buttocks when the connectors on the ends of said first and second straps are connected.

4. A floatation device comprised of pieces of buoyant material, a first piece of buoyant material being shaped in a "U" that is inverted for wearing by a person, the "U" shape of said first piece of buoyant material being defined by two stems and a counter, the person wearing said floatation device by sitting down into the end of the "U" of said "U"-shaped first piece of buoyant material opposite the counter of the "U" with the stems of the "U" being arrayed on either side of the person's buttocks, second and third pieces of buoyant material attached to the stems of the "U" of said first, "U"-shaped piece of buoyant material at approximately the waist of the person wearing said floatation device, an elongate strap affixed to each of said first, "U"-shaped and said second and third pieces of buoyant material for wrapping all of said first, second, and third pieces around the person's waist, fourth and fifth "T"-shaped pieces of buoyant material attached to both said first, "U"-shaped and respective second and third pieces of buoyant material, the "T" shape of said fourth and fifth pieces of buoyant material being defined by a stem and a crossbar with the "T" being inverted for wearing by the person and respective elongate straps affixed to said fourth and fifth, "T"-shaped pieces of buoyant material and oriented in a direction substantially parallel to the crossbar of the "T" of the respective fourth and fifth, "T"-shaped pieces of buoyant material for wrapping around respective thighs of the person.

* * * * *